US005971051A

United States Patent [19]

Crankshaw

[11] Patent Number: 5,971,051

[45] Date of Patent: Oct. 26, 1999

[54] LABEL APPLICATOR WITH MASK AND GAS DISTRIBUTOR

[75] Inventor: Michael Crankshaw, Santa Fe Springs, Calif.

[73] Assignee: Label-Aire, Inc., Fullerton, Calif.

[21] Appl. No.: 09/025,920

[22] Filed: Feb. 19, 1998

[51] Int. Cl.[6] ..... B65C 9/28

[52] U.S. Cl. ..... 156/541; 156/497; 156/542; 156/556; 156/DIG. 38

[58] Field of Search ..... 156/DIG. 38, 542, 156/556, 541, 249, 540, 497; 269/21

[56] References Cited

U.S. PATENT DOCUMENTS

| | | | |
|---|---|---|---|
| 3,379,466 | 4/1968 | Hughes . | |
| 3,729,362 | 4/1973 | French et al. . | |
| 3,885,705 | 5/1975 | French . | |
| 3,888,725 | 6/1975 | French . | |
| 3,984,277 | 10/1976 | French et al. . | |
| 4,526,648 | 7/1985 | Tochtermann | 156/DIG. 38 X |

*Primary Examiner*—Curtis Mayes

*Attorney, Agent, or Firm*—Stout, Uxa, Buyan & Mullins, LLP; Donald E. Stout

[57] ABSTRACT

A label applicator for applying a label to an article which includes a supporting structure and an applicator section mounted on the supporting structure and including a housing adapted to be coupled to a supply of gas under pressure and having a label receiving surface with an opening therein. A label dispenser for dispensing a label onto the label receiving surface where it is retained in at least partial registry with the opening. The applicator section includes a rupturable mask adapted to be in the housing in communication with the supply of gas under pressure and the opening in the label receiving surface, and the mask includes a grid having a plurality of holes extending therethrough and rupturable material blocking at least some of the holes. The rupturable material is rupturable to open selected holes in the grid so that the gas under pressure can flow through the selected holes so that the shape of the gas under pressure acting to blow the label from the label receiving surface can be tailored. A gas distributor is upstream from the mask for making the flow of gas under pressure toward the selected holes even.

15 Claims, 5 Drawing Sheets

LABEL APPLICATOR WITH MASK AND GAS DISTRIBUTOR

BACKGROUND OF THE INVENTION

A typical label applicator applies one or more labels to an article as the article is conveyed past the label applicator. For example, a label applicator may include a label dispenser which dispenses a label onto a label receiver or applicator section. The applicator section then transfers the label to the article, and this is often accomplished by a blast of gas, typically air, under pressure.

The label is releasably retained on a label receiving surface of the applicator section by vacuum pressure. The blast of gas under pressure must be sufficiently forceful to overcome the vacuum pressure tending to retain the label against the label receiving surface. To assure that the label undergoes relatively stable flight from the label receiving surface to the article, it is also important that the blast of gas under pressure have a shape, i.e. a cross section, which is compatible with the shape of the label being applied to the article.

In the past, various techniques have been used to tailor the shape of the gas under pressure acting to blow the label from the label receiving surface to the article. One technique involves the repositioning of air tubes to shape the blast of gas. Another technique, which is shown by way of example in French U.S. Pat. No. 3,888,725, utilizes a mask which contains openings, the number and location of which are selected in accordance with the desired gas pattern configuration. A mask is very satisfactory for this purpose; however, it is important to be able to quickly provide a different mask to accommodate a label having a different configuration. Speed is important because whenever a labeling line is required to apply a label having a different shape, the entire line must be shut down while the label applicator is appropriately adjusted to accommodate the shape of the new label. The mask of the label applicator of the French patent can be quickly changed; however, a new mask for each new label cannot be created as quickly as desired.

In order to have stable label flight from the label receiving surface of the applicator section to the article, it is also important that the force applied to the label by the gas under pressure be substantially the same at each location on the label where the gas under pressure acts. The French patent discloses an air diffuser which is said to distribute the air under pressure to all portions of the openings so that no portion of the openings is starved for air. However, the system disclosed in the French patent is not believed able to achieve the desired evenness of forces acting on the label.

SUMMARY OF THE INVENTION

This invention provides a label applicator with a mask which can be quickly and easily adapted to the shape of the label being applied. In addition, this invention provides a gas distributor for a label applicator which makes the flow of gas under pressure toward the label even so that the forces acting on the label are even and the label is transported in stable flight to the article.

These features may be embodied in a label applicator which includes a supporting structure and an applicator section mounted on the supporting structure. The applicator section may include a housing adapted to be coupled to a supply of gas under pressure and have a label receiving surface with an opening therein. The label applicator may also include a label dispenser for dispensing a label onto the label receiving surface with the applicator section releasably retaining the label against the label receiving surface in at least partial registry with the opening so that the label can be blown by the gas under pressure from the label receiving surface and applied to the article.

To tailor the shape of the gas under pressure acting to blow the label from the label receiving surface the applicator section includes a rupturable mask adapted to be in the housing in communication with the supply of gas under pressure and the opening in the label receiving surface. The mask may include a grid having a plurality of holes extending therethrough and rupturable material blocking at least some of the holes. The rupturable material is easily rupturable to open selected holes in the grid so that the gas under pressure can flow through those selected holes. This enables the shape of the gas under pressure acting to blow the label from the label receiving surface to be tailored.

Viewed from a different perspective, the mask may be considered as having a plurality of indicia and rupturable material at the indicia. The rupturable material is rupturable to form holes through the mask so that the shape of the gas under pressure acting to blow the label from the label receiving surface can be tailored.

An advantage of the rupturable material is that it can easily be ruptured or penetrated by a pointed object to quickly create a hole pattern which is compatible with the shape of the label to be applied to the article. The indicia indicate the possible choices for making holes through the mask, and the indicia may include markings and/or the holes formed in the grid. In any event, it is a simple task to puncture the rupturable material at the location desired to provide the desired shape of the gas under pressure which will act to blow the label from the label receiving surface.

In a preferred construction, the rupturable material includes a rupturable sheet attached to and confronting the grid. The rupturable sheet covers some or all of the holes in the grid and can be easily punctured to open the desired holes of the grid. The rupturable sheet may have the indicia identifying the location of the holes in the grid, or if desired, the holes in the grid themselves may be considered to be the indicia.

The label applicator may also include a gas distributor for making the flow of gas under pressure to the desired areas, and hence the force tending to blow the label from the label receiving surface, evenly. The gas distributor may include a plurality of upstream chambers for receiving gas from the supply of gas under pressure and a plurality of downstream chambers in communication with the opening in the label receiving surface. Each of the upstream chambers supplies gas under pressure to at least two of the downstream chambers. Preferably, although not necessarily, the gas distributor also has a third plurality of chambers downstream from the downstream chambers with each of the downstream chambers supplying gas under pressure to at least two of the third plurality of chambers. Although any number of groups of chambers can be used, three groups are preferred. This has been found sufficient to make the gas under pressure available to all regions of the mask and to assist in achieving the desired evenness of the air flow.

Preferably, each of the upstream chambers has an inlet port for receiving gas under pressure from the supply of gas under pressure and at least first and second outlet ports which are spaced about equally from the inlet port of the associated chamber. Each of the first and second outlet ports leads to a different one of the downstream chambers. Similarly, if the third plurality of chambers is employed, then each of the outlet ports of the downstream chambers leads to an inlet port for one of the third plurality of chambers and each of the third plurality of chambers has at least first and second outlet ports.

To achieve the desired evenness of air flow, the outlet ports from each of the chambers is preferably about equally spaced from the inlet port of the associated chamber. Preferably, although not necessarily, each of the inlet ports of each of the chambers is centered in its chamber.

In a broader sense, it is only necessary that each of the inlet ports and outlet ports be sized and located to achieve the desired evenness of gas flow and/or gas pressure. For example, this can be done such that the gas pressure at the outlet ports of the upstream chambers is substantially the same as the label is blown from the label receiving surface. Although this can be achieved in different ways, such as by variation in size of the ports and the number of the ports, it is preferred to center each inlet port in its chamber and space the outlet ports of that chamber equally from the associated inlet port.

In terms of mechanical construction, it is preferred that the gas distributor include a plurality of confronting plates. This enables the chambers including the upstream chambers, the downstream chambers and the third plurality of chambers to be in those plates. Also, some of the plates may have intersecting grooves for use in defining the upstream and downstream chambers.

Although the mask and gas distribution features of this invention may be used separately, there are advantages in terms of stable label flight to use them together. In this event, the gas distributor is preferably located upstream from the mask. When a mask is used gas distribution is especially important because gas under pressure may be demanded or prevented from passing through any region of the mask depending upon the hole pattern of the mask which is utilized to obtain the best shape gas distribution pattern for the label being applied.

In a preferred construction, the applicator section includes first and second confronting plates with each of these plates having confronting apertures. The first plate has a recess with an open side which confronts the second plate and the mask is receivable into the recess. At least one resilient member is provided for biasing the second plate toward the first plate to at least partly close the open side of the recess. Interlocking members are preferably provided on the mask and the second plate for use in retaining the mask in the recess. The second plate is movable away from the first plate against the resilient biasing of the resilient member to allow the interlocking members to release so that the mask can be withdrawn from the recess. This facilitates ease of insertion and withdrawal of the mask from the applicator section.

The invention, together with additional features and advantages thereof, may best be understood by reference to the following description taken in connection with the accompanying illustrative figures.

DESCRIPTION OF THE PREFERRED EMBODIMENT

Figure 1:
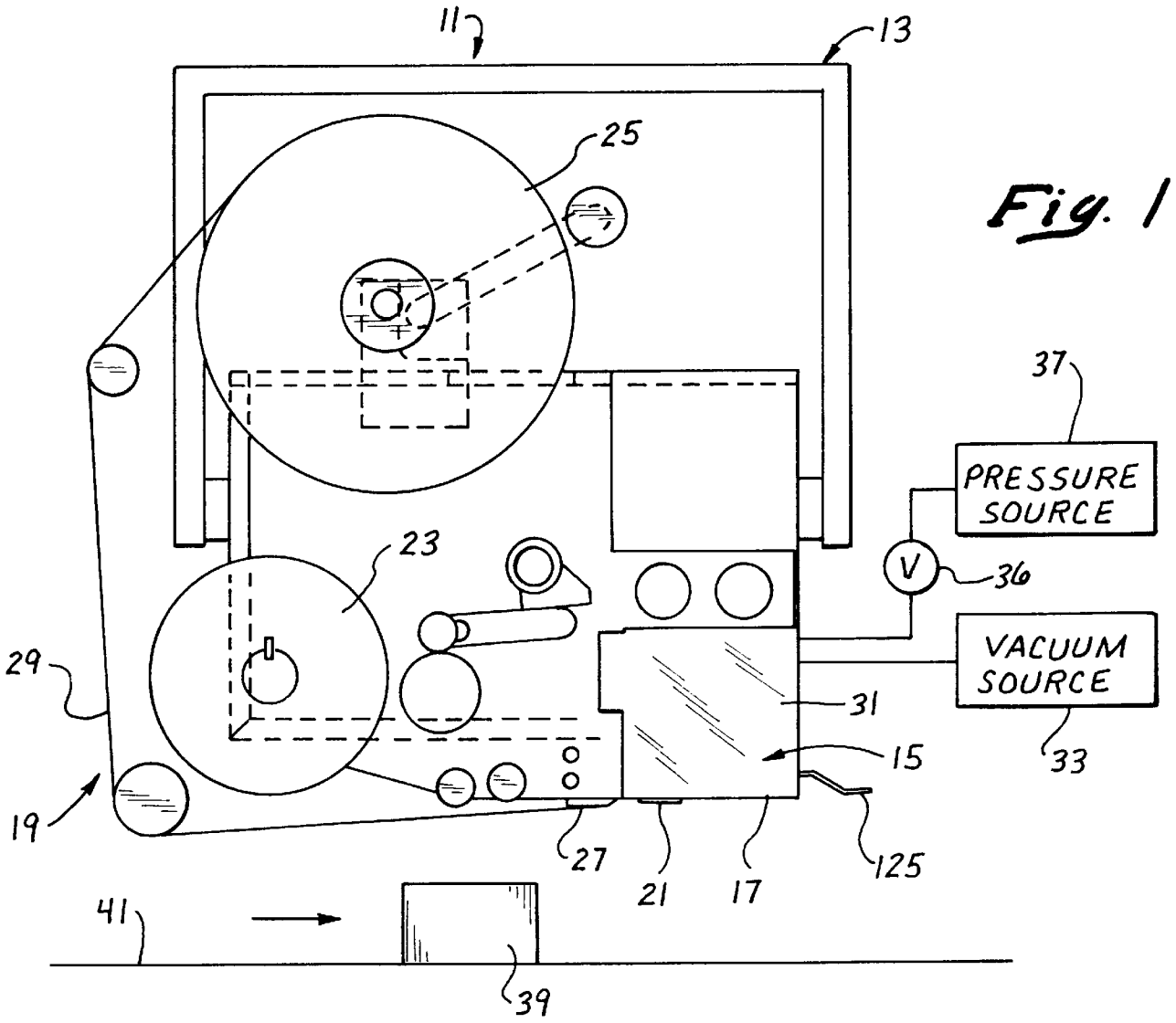
FIG. 1 is a somewhat schematic side-elevational view of a label applicator constructed in accordance with the teachings of this invention and of a conveyer line.

FIG. 1 shows a label applicator 11 which generally comprises a supporting structure 13, an applicator section 15 mounted on the supporting structure and having a label receiving surface 17 and a label dispenser 19 mounted on the supporting structure for dispensing a label 21 onto the label receiving surface 17. Except for portions of the applicator section 15, the label applicator 11 may be of conventional construction. Thus, the label dispenser 19 includes the usual supply reel 23, take-up reel 25 and a peeler bar 27 suitably mounted on the supporting structure 11. Pressure sensitive adhesive labels are adhered to a backing strip 29 and the backing strip is wound on the supply reel 23 and the take-up reel 25. By moving the backing strip over the peeler bar 27 in a known and controlled fashion, the labels 21 can be sequentially removed from the backing strip and dispensed onto the label receiving surface 17 of the applicator section 15 in the usual manner.

Figure 2A:
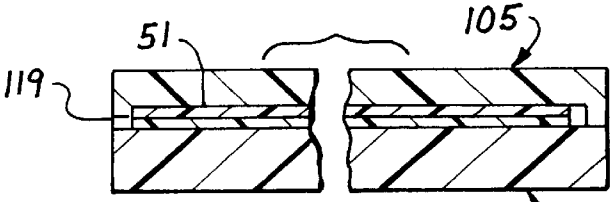
FIG. 2A is a sectional view taken generally along line 2A—2A of FIG. 2.
Figure 2:
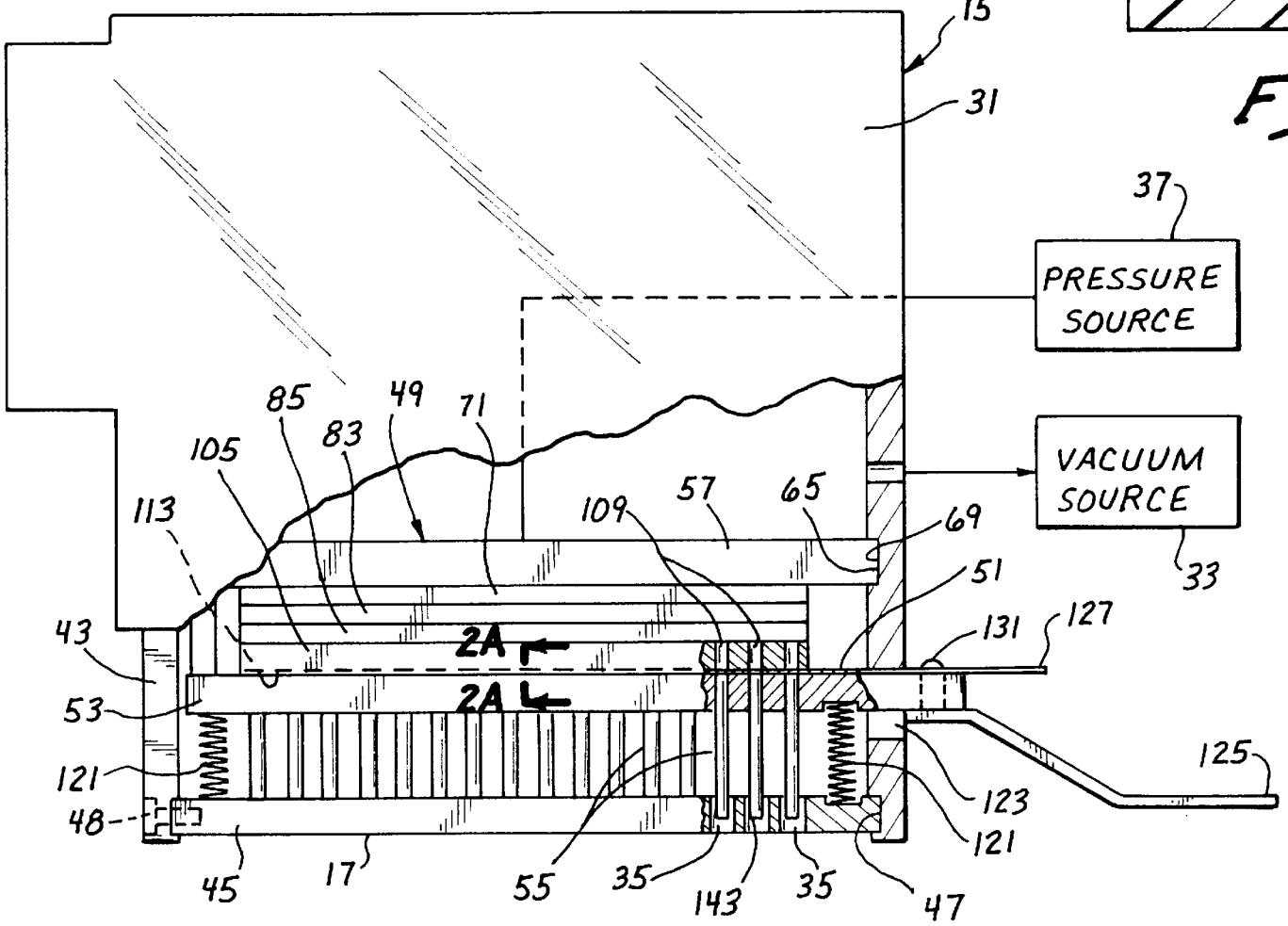
FIG. 2 is a side-elevational view partially in section of the applicator section of the label applicator.
Figure 4:
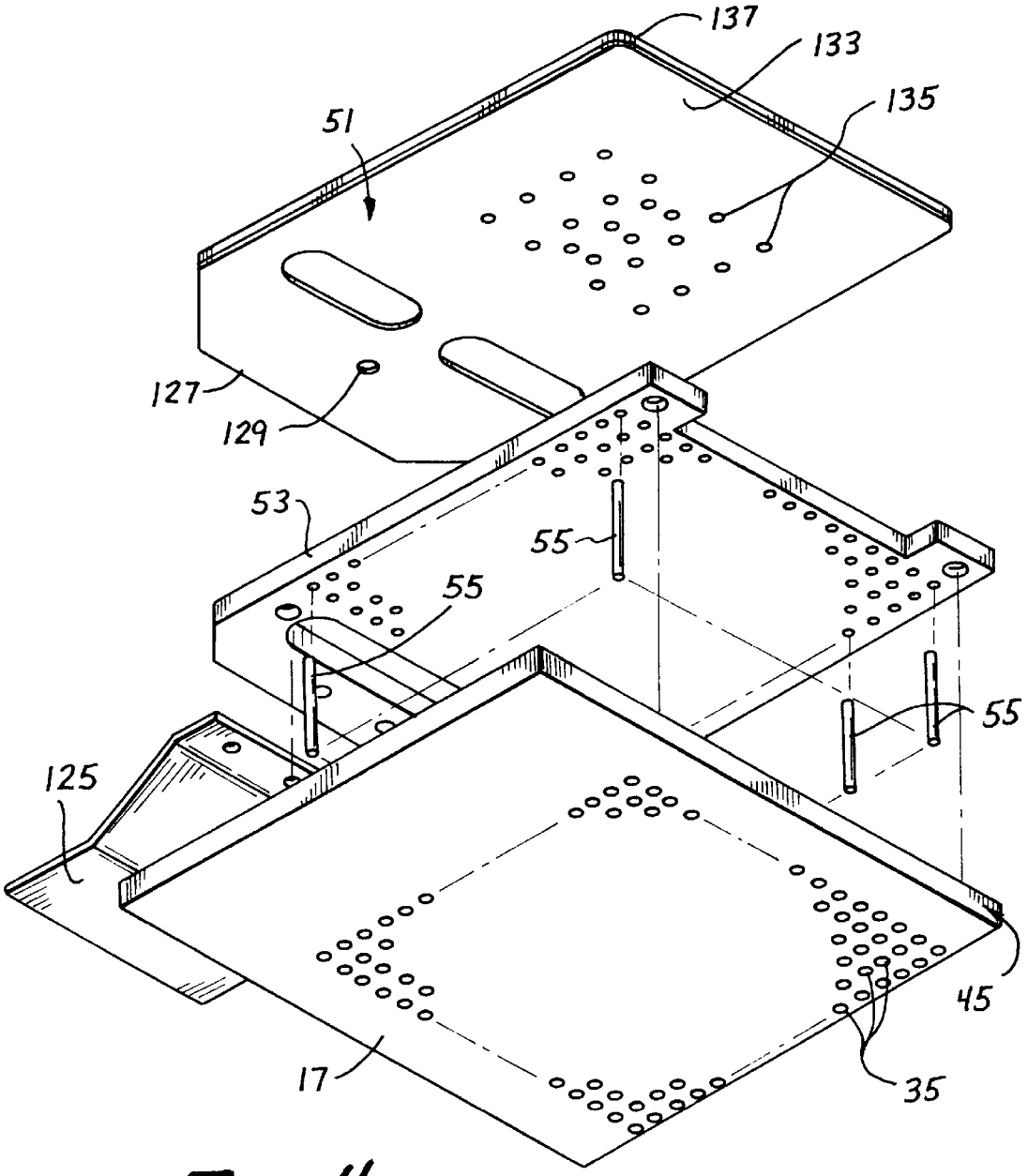
FIG. 4 is an exploded perspective view of the mask and a portion of the applicator section downstream of the mask.

The applicator section 15 includes a housing 31 mounted on the supporting structure and coupled to a vacuum source 33. As shown in FIGS. 2 and 4, the label receiving surface 17 has an opening in the form of a plurality of apertures 35, and the vacuum source 33 causes a negative air pressure to be present at each of these apertures. Consequently when the label 21 is dispensed onto the label receiving surface 17, this vacuum pressure, which continuously acts as the housing 31, releasably retains the label against the label receiving surface in a conventional manner. The housing 31 is also coupled via a control valve 36 to a pressure source 37 of a suitable gas under pressure such as air, so that by opening the valve 36 for an instant, the label 21 on the label receiving surface 17 is exposed to the source of gas under pressure and is blown from the label receiving surface onto an article 39 which is being conveyed past the label applicator 11 on a conveyor belt 41. The control valve 36 can be opened by a signal from, for example, a photoelectric cell (not shown) as the article 39 approaches the label 21 so that the label is blown off of the label receiving surface 17 at the appropriate time.

FIGS. 2–5 show a preferred construction for shaping the gas under pressure which acts to blow the label 21 from the label receiving surface 17 and for evenly distributing the gas under pressure toward the appropriate region of the label receiving surface. In the orientation shown in FIG. 1, this portion of the applicator section 15 is the lower portion.

From FIG. 2 it can be seen that the housing 31 has a peripheral wall 43 and an end wall 45 mounted in a groove 47 of the peripheral wall 43. The end wall 45 may be retained in the groove 47 in any suitable manner, such as a set screw (not shown). The label receiving surface 17 is the outer surface of the end wall 45, and the end wall 45 contains the apertures 35 which extend completely through the end wall into the interior of the housing 31.

The applicator section 15 may be considered including a gas distributor 49 suitably mounted within the housing 31 and a mask 51 downstream of the gas distributor. Downstream of the mask 51 is a jet tube grid 53 which has a plurality of jet tubes 55 affixed to it and projecting through the apertures 35, respectively of the end wall 45.

Figure 3:
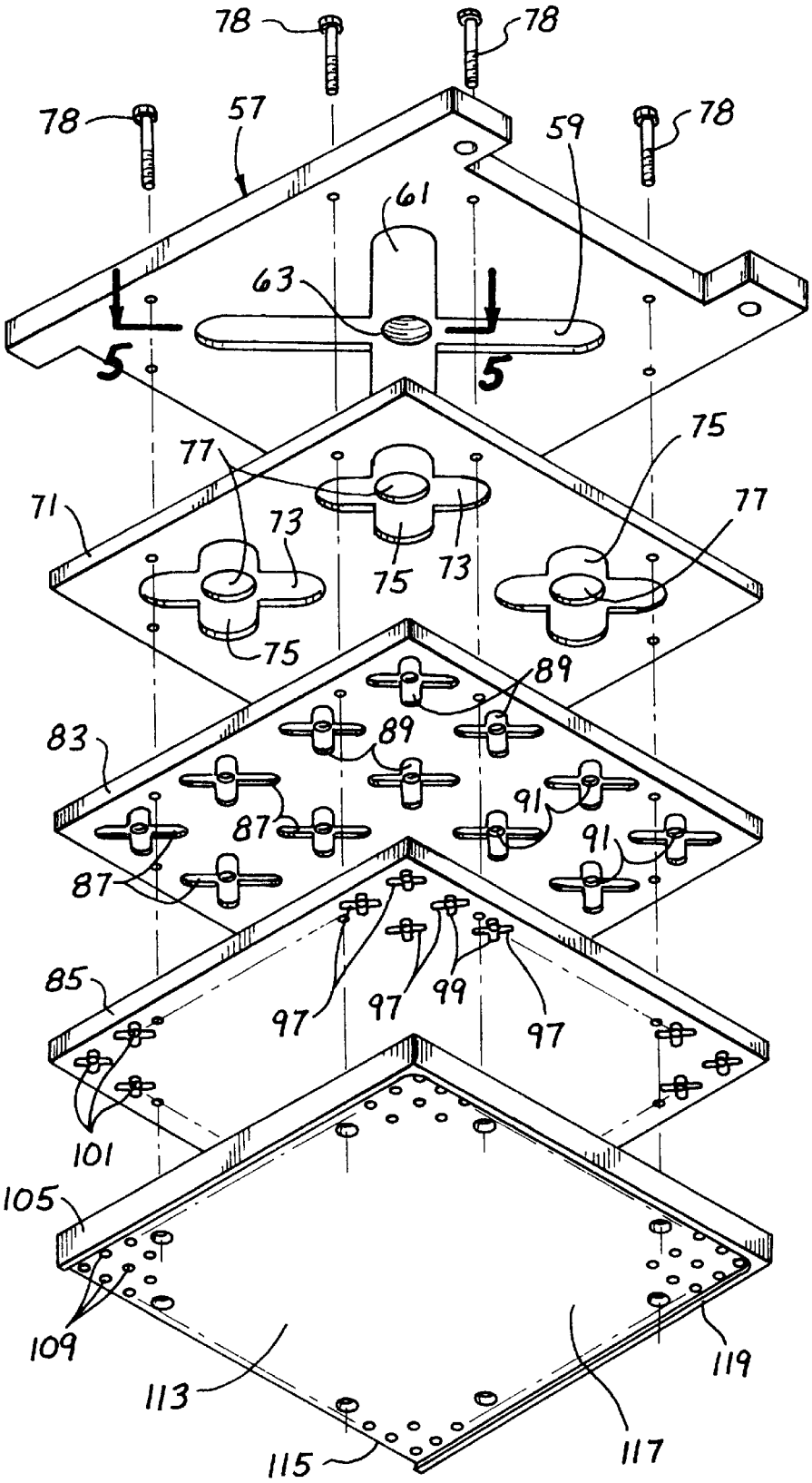
FIG. 3 is an exploded perspective view of the gas distributor.
Figure 5:
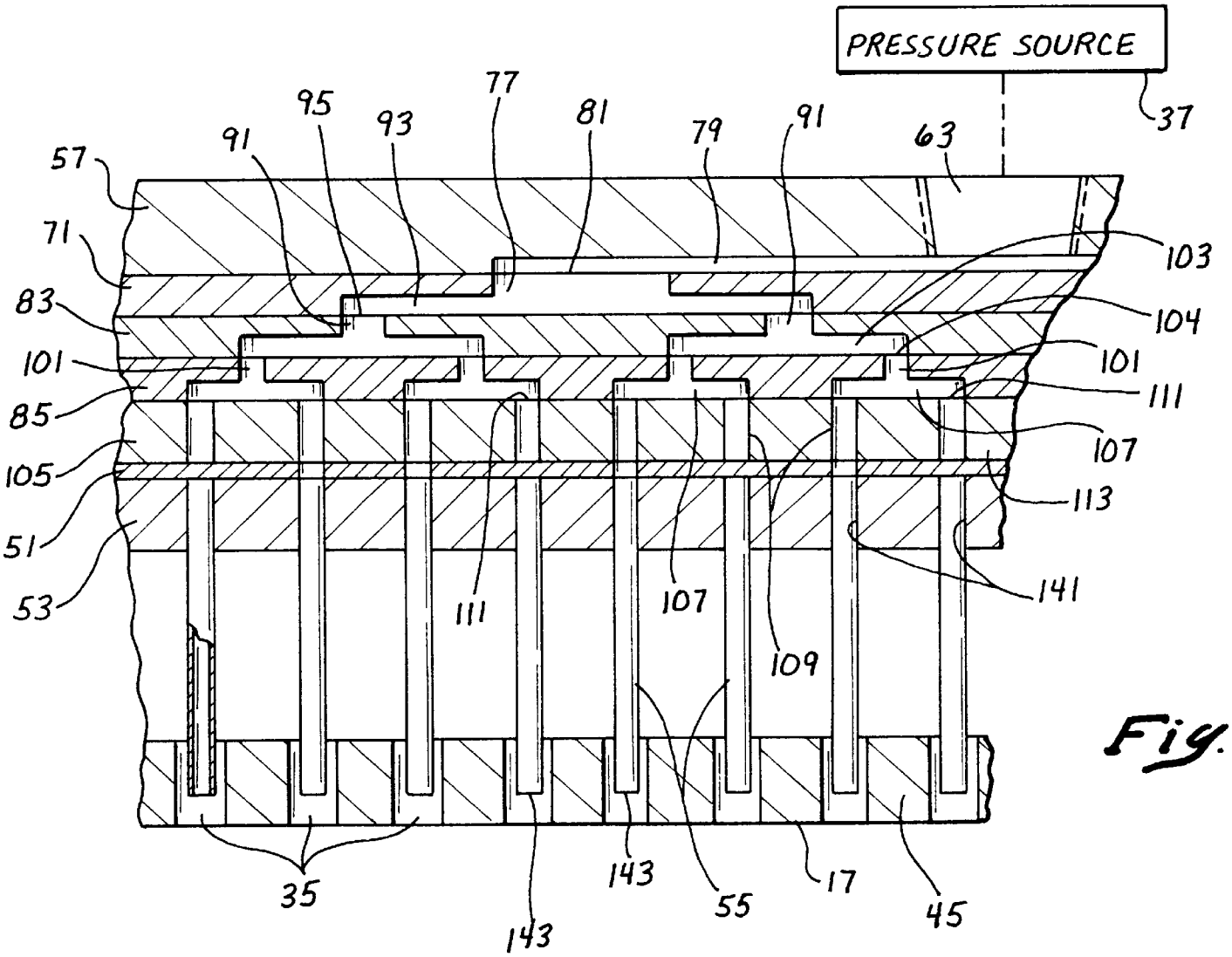
FIG. 5 is an enlarged fragmentary sectional view of a portion of the applicator section which includes the gas distributor, the mask and portions of the applicator section downstream of the mask.

The gas distributor 49 includes a plurality of confronting plates with the uppermost of such plates as viewed in FIGS. 2 and 3 being a grid manifold 57. The grid manifold 57 has intersecting grooves 59 and 61 (FIG. 3) formed in its lower surface and an inlet port 63 at the intersection of the grooves. The grid manifold 57 is suitably mounted within the housing 31 in any suitable manner, and in the embodiment illustrated, an edge 65 of the grid manifold 57 is received within a groove 69 on the inner face of the peripheral wall 43. The grid manifold 57 is held tightly within the groove 69 in any suitable manner such as by a set screw (not shown) so that the grid manifold is firmly and rigidly mounted on and within the housing 31. The pressure source 37 is suitably coupled to the inlet port 63 (FIG. 5).

The gas distributor 49 also includes chamber plate 71 which has a plurality of sets (four being illustrated in FIG. 4) of intersecting grooves 73 and 75 with each set of intersecting grooves having an inlet port 77 at the intersection of the associated grooves. The grooves 73 and 75 of each set are perpendicular and intersect at their midpoints. The chamber plate 71 is affixed to the grid manifold 57 in any suitable manner such as by screws 78 (FIG. 3) with each of the inlet ports 77 in registry with and communicating with an outer region of one of the grooves 59 and 61 of the grid manifold. The grid manifold 57 and the plate are in face-to-face abutting relationship as shown in FIG. 5 so that the plate 71 closes off major portions of the grooves 59 and 61 to define an inlet chamber 79 with four outlet ports 81 (FIG. 5) at the ends of the grooves 59 and 61 with each of the outlet ports being in registry and communicating with an inlet port 77.

Chamber plates 83 and 85 are also suitably affixed to the grid manifold 57 by the screws 78. The chamber plate 83 has a plurality (16 being illustrated in FIG. 3) of sets of perpendicular grooves 87 and 89 which intersect at their midpoints with each pair of the intersecting grooves having an inlet port 91 at the intersection of the associated pair of grooves. The chamber plate 71 and 83 are in face-to-face abutting relationship so that they cooperate to form a plurality of upstream chambers 93 (four being illustrated, i.e. one for each pair of intersecting grooves 73 and 75) each having an outlet 95 near the end of each of the grooves 73 and 75 with each of the outlets 95 being in registry with and leading directly to one of the inlet ports 91.

The chamber plate 85 also has a plurality (64 being illustrated) of sets of perpendicular grooves 97 and 99 which intersect at their midpoints with an inlet port 101 at the intersection of each pair of grooves. The chamber plates 83 and 85 are also in face-to-face confronting relationship to define a plurality (16 being illustrated) of intermediate chambers 103 which are downstream of the associated upstream chambers. Each of the intermediate chambers 103 has an outlet 104 at the ends of each of the grooves 87 and 89 which are in registry with and lead directly to an inlet port 101.

The gas distributor 49 also has a grid plate 105 which is also mounted on the grid manifold 57 by the screws 78. The grid plate 105 is in confronting face-to-face relationship with the chamber plate 85 to define a third plurality (64 being illustrated) of chambers or downstream chambers 107, with one of the inlet ports 101 leading to each of the downstream chambers. The grid plate 105 has a plurality of apertures 109 in registry respectively with outlets 111 at opposite ends of each of the grooves 97 and 99 of the chamber plate 85. Thus, each of the outlets 111 of the downstream chambers 107 lead directly to one of the apertures 109.

An important function of the air distributor of the gas distributor is to supply gas to each of the apertures 109 at a relatively even or equal pressure and volume. In the preferred embodiment, several factors contribute to this advantageous result. For example, the use of multiple chambers in series facilitates gas distribution to all of the many apertures 109 with the progressively increasing number of chambers in the downstream direction assisting to provide for the feeding of gas to the many apertures 109. In this embodiment, the outlet ports are spaced about equally from the associated inlet ports in each of the chambers 93, 103 and 107, and this is also true in the inlet chamber 79. If this were not the case, gas would get to one of the chambers ahead of the other and this would result in the gas pressure being uneven at the apertures 109 during the very short interval, such as 15 milliseconds, during which the blast of gas under pressure is applied to blow the label from the label receiving surface 17. Also, in this preferred embodiment, each of the inlet ports of each of the chambers 93, 103 and 107 is preferably centered in the associated chamber, and this is also true of the inlet port 63 for the inlet chamber 79. In the embodiment illustrated, each of the outlet ports or outlets 81, 95, 104, and 111 are coextensive in area with the inlet port which they supply. Thus, each of the inlet ports and the associated outlet ports of the same chamber are sized and located such that the gas pressure at the outlet ports of the same chamber is substantially the same as the label is blown from the label receiving surface.

As shown in FIG. 3, the grid plate 105 has a downwardly opening recess 113 and the recess has an open end 115 to receive the mask 51 and an open side or bottom 117. The mask 51 is received in the recess 113 as shown in FIGS. 2 and 5 with a rib 119 (FIG. 3) confining and guiding the mask.

The jet tube grid 53 is immediately below the mask 51 in the orientation shown in the drawings. The jet tube grid 53 confronts the grid plate 105 and acts to at least partially close the open side 117 of the recess 113 to thereby tend to capture the mask 51 in the recess 113. However, it is important that the mask 51 be easily removable from the recess 113, and accordingly, the jet tube grid 53 is biased by resilient members in the form of a plurality of springs 121 (FIG. 2) toward the grid plate 105 to at least partially close the open side 117 of the recess 113. The jet tube grid 53 extends through an opening 123 (FIG. 2) in the housing 31 and the opening 123 is large enough vertically in the orientation shown in FIG. 2 to permit movement of the jet tube grid toward and away from the grid plate 105. A handle 125 is affixed to the portion of the jet tube grid 53 outside the housing 31 to facilitate movement of the jet tube grid 53 downwardly away from the grid plate 105.

A handle portion 127 of the mask 51 also projects through the opening 123. The handle portion 127 has a hole 129 (FIG. 4) which is adapted to receive a pin 131 (FIG. 2) of the jet tube grid 53 to releasably retain the mask in the recess 113 and within the housing 31. The hole 129 and the pin 131 form interlocking members which retain the mask in the recess 113. The jet tube grid 53 is movable away from the grid plate 105 against the resilient biasing of the springs 121 to allow the interlocking members, i.e. the pin 131 and the hole 129 to release so that the mask 51 can be withdrawn from the recess 113.

Figure 6:
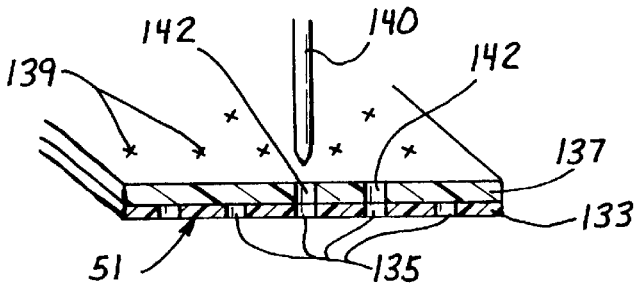
FIG. 6 is a fragmentary perspective view showing one preferred mask.

The mask 51 includes a grid 133 (FIG. 6) having a plurality of holes 135 extending through the grid and rupturable material blocking at least some of the holes. In the preferred embodiment illustrated, the rupturable material includes a rupturable layer 137 covering at least some of the holes. In this embodiment, the rupturable layer 137 covers all of the holes 135 in the grid 133. The rupturable layer 137 is rupturable to open selected holes 135 in the grid 133. This allows the gas under pressure to flow through the selected or open holes so that the shape of the gas under pressure acting to blow the label 21 from the label receiving surface 17 can be tailored. The rupturable sheet 137 can be made of any material which is relatively easy to puncture, such as paper or suitable polymeric material, and it is preferably adhered to the upper face of the grid 133 as viewed in FIG. 6. The grid 133 on the other hand may be constructed of a more rigid, not readily puncturable material such as a rigid polymeric material or a metal.

As shown in FIGS. 2 and 5, the mask 51 is in the housing 31 in communication with the pressure source 37 and the apertures 35 in the label receiving surface 17. Consequently, the cross-sectional configuration or shape of the blast of gas emanating from the apertures 35 will depend upon the rupturing or puncturing of the rupturable sheet 137 to expose particular holes 135. To facilitate the puncturing of the rupturable sheet 137 at the desired locations, the rupturable sheet preferably has indicia 139 on its outer surface identifying the location of the holes in the grid 133.

To tailor a mask and hence the shape of the gas blast to a particular label configuration, a label is placed over the mask 51 at the desired location. The rupturable sheet 137 is then punctured by a suitable pointed tool 140 (FIG. 6) to form openings 142 to expose those holes 135 which lie within, and if desired, just outside of the area covered by the label. The resulting mask 51 is then adapted or especially suited for use with labels of that particular configuration. Of course, this process can be quickly carried out so that the time to adapt a mask 51 for a label of any given configuration is short. Thus, the mask 51 has a plurality of indicia 139 and rupturable material at the indicia with the rupturable material being rupturable to form openings 142 through the rupturable layer 137 and holes completely through the mask so that the shape of the gas under pressure acting to blow the label 21 from the label receiving surface 17 can be tailored.

Each of the jet tubes 55 has an upstream end portion received within an opening or aperture 141 of the jet tube grid 53 and the upper ends of each of the jet tubes is flush with the upper surface of the jet tube grid. Each of the jet tubes 55 is preferably relatively rigid and may be constructed of a suitable polymeric material. In this embodiment, each of the jet tubes 55 terminates in a downstream end 143, and these downstream ends are received within the apertures 35, respectively, of the end wall 45 as shown in FIGS. 2 and 5. In the embodiment illustrated, each of the ends 143 is recessed slightly above the label receiving surface 17.

With this construction, it can be seen that the mask 51 is located between the gas distributor 49 and the label receiving surface 17 where it can selectively block off gas from the outlets 111 of the downstream chambers 107. The gas distributor 49 makes the flow of gas under pressure from the pressure source 37 toward the selected or open holes 135 in the grid 133 more even.

In use of the label applicator 11, the mask 51 is first prepared as described above to provide the desired shape for the blast of gas under pressure. Specifically, the mask 51 is punctured as described above to provide a shape for the blast of gas under pressure which is geometrically similar to the shape of the labels to be applied. The handle 125 can be pressed against the biasing action of the springs 121 to provide a relatively large gap between the jet tube grid 53 and the grid plate 105 so that the mask 51 can be inserted into this gap and be received by the recess 113 as described above. The mask 51 is releasably retained in the position shown in FIG. 2 by the pin 131 which is received within the hole 129 of the mask. The label applicator 11 is then operated in a conventional manner by conveying the article 39 past the label receiving surface 17 on the conveyer belt 41 as shown in FIG. 1. The labels 21 are then sequentially transferred to the articles 39 by applying a blast of gas from the pressure source 37 to the labels 21. This blast of gas is of very short duration and is of sufficient force to overcome the force of the vacuum which releasably retains the label 21 on the label receiving surface 17. The blast of gas from the pressure source 37 travels sequentially from the inlet chamber 79 (FIG. 5) through the upstream chambers 93, the intermediate chamber 103 and the downstream chambers 107 to the open holes 135 of the mask 51. From there, the gas flows through the jet tubes 55 which are in communication with the open holes 135 to the label on the label receiving surface 17 to blow that label onto the article which is adjacent the label receiving surface 17. With the outlets from each of the chambers 79, 93, 103 and 107 all being equally spaced from the inlets of the associated chamber, substantially equal quantities of gas at substantially equal pressures is conducted to each of the open holes 135 of the mask 51. It should also be noted that in this embodiment that the inlets to each of the upstream chambers 93 is of the same cross-sectional area so that each of the upstream chambers can receive substantially equal quantities of gas from the inlet chamber 79. Similarly, the inlets 91 of the intermediate chambers 103 are all of the same cross-sectional area and the inlets 101 of the downstream chambers 107 are of the same cross-sectional area, and this assures that each of the intermediate chambers will receive substantially the same quantities of gas at substantially the same pressure, and that each of the downstream chambers 107 will receive substantially the same volume of gas at substantially the same pressure, at least when the gas under pressure is first applied to blow the label 21 from the label receiving surface 17. Because the mask 51 may block off all, some or none of the outlets 111 of the downstream chambers 107, the total quantity of gas ultimately supplied to each of the downstream chambers may vary somewhat during the very short duration, e.g. 15 milliseconds, when the gas under pressure is being applied. In any event, the open holes 135 of the mask 51 receive substantially the same quantities of gas at substantially the same pressure so that the label 21 can be transferred in a relatively stable manner to the article 39.

Although an exemplary embodiment of the invention has been shown and described, many changes, modifications and substitutions may be made by one having ordinary skill in the art without necessarily departing from the spirit and scope of the invention.

I claim:

1. A label applicator for applying a label to an article, comprising:

a supporting structure;

an applicator section mounted on the supporting structure and including a housing adapted to be coupled to a supply of gas under pressure and having a label receiving surface, said label receiving surface having an opening therein;

a label dispenser for dispensing a label onto said label receiving surface, said applicator section retaining the label against the label receiving surface in at least partial registry with said opening whereby the label can be blown by the gas under pressure from the label receiving surface and applied to an article;

said applicator section including a rupturable mask adapted to be in said housing in communication with the supply of gas under pressure and the opening in the label receiving surface; and said mask including a grid having a plurality of holes extending therethrough and a rupturable layer of easily puncturable polymeric material disposed over said grid, said rupturable layer of material blocking at least some of the holes, said rupturable material being selectively rupturable to open selected holes in the grid so that the gas under pressure can flow through said selected holes whereby the shape of the gas under pressure acting to blow the label from the label receiving surface can be tailored.

2. A label applicator as defined in claim 1 wherein said rupturable layer of material comprises a rupturable sheet covering some of said holes.

3. A label applicator as defined in claim 2 wherein said rupturable sheet has indicia identifying the location of said holes in said grid.

4. A label applicator as defined in claim 1 including a gas distributor upstream from said mask for making the flow of gas under pressure toward said selected holes even, said gas distributor including a plurality of upstream chambers for receiving gas from the supply of gas under pressure and a plurality of downstream chambers in communication with the holes in the mask, and each of said upstream chambers supplies gas under pressure to at least two of the downstream chambers.

5. A label applicator as defined in claim 4, wherein each of said upstream chambers has an inlet port for receiving gas under pressure from the supply of gas under pressure and at least first and second outlet ports which are spaced about equally from the inlet port of the associated chamber, and each of said first and second outlet ports leads to a different one of said downstream chambers.

6. A label applicator as defined in claim 5 wherein each of said inlet ports of said upstream chambers is centered in the associated upstream chamber.

7. A label applicator as defined in claim 5 wherein each of said inlet ports and outlet ports of the upstream chambers is sized and located such that the gas pressure at the outlet ports of the upstream chambers is substantially the same as the label is blown from the label receiving surface.

8. A label applicator as defined in claim 5 wherein each of said downstream chambers has at least first and second outlet ports, said gas distributor has a third plurality of chambers and each of said outlet ports of said downstream chambers leads an inlet port for one of said third plurality of chambers, each of said third plurality of chambers has at least first and second outlet ports which are spaced about equally from said inlet port of the associated chamber of said third plurality of chambers.

9. A label applicator as defined in claim 1 wherein the applicator section includes first and second confronting plates, said first and second plates having confronting apertures, said first plate having a recess with an open side which confronts the second plate, said mask being receivable in said recess, and at least one resilient member for biasing the second plate toward the first plate to at least partly close said open side of the recess.

10. A label applicator for applying a label to an article, comprising:

a supporting structure;

an applicator section mounted on the supporting structure and including a housing adapted to be coupled to a supply of gas under pressure and having a label receiving surface, said label receiving surface having an opening therein;

a label dispenser for dispensing a label onto said label receiving surface, said applicator section retaining the label against the label receiving surface in at least partial registry with said opening whereby the label can be blown by the gas under pressure from the label receiving surface and applied to an article;

said applicator section including a rupturable mask adapted to be in said housing in communication with the supply of gas under pressure and the opening in the label receiving surface; and said mask including a grid having a plurality of holes extending therethrough and a rupturable layer of paper material disposed over said grid, said rupturable layer of material blocking at least some of the holes, said rupturable material being selectively rupturable to open selected holes in the grid so that the gas under pressure can flow through said selected holes whereby the shape of the gas under pressure acting to blow the label from the label receiving surface can be tailored.

11. A label applicator for applying a label to an article, comprising:

a supporting structure;

an applicator section mounted on the supporting structure and including a housing adapted to be coupled to a supply of gas under pressure and having a label receiving surface, said label receiving surface having an opening therein; the applicator section further including first and second confronting plates, said first and second plates having confronting apertures, said first plate having a recess with an open side which confronts the second plate, said mask being receivable in said recess, and at least one resilient member for biasing the second plate toward the first plate to at least partly close said open side of the recess;

a label dispenser for dispensing a label onto said label receiving surface, said applicator section retaining the label against the label receiving surface in at least partial registry with said opening whereby the label can be blown by the gas under pressure from the label receiving surface and applied to an article;

said applicator section including a rupturable mask adapted to be in said housing in communication with the supply of gas under pressure and the opening in the label receiving surface;

said mask including a grid having a plurality of holes extending therethrough and rupturable material blocking at least some of the holes, said rupturable material being rupturable to open selected holes in the grid so that the gas under pressure can flow through said selected holes whereby the shape of the gas under pressure acting to blow the label from the label receiving surface can be tailored; and interlocking members on the mask and the second confronting plate for retaining the mask in the recess, said second confronting plate being movable away from the first confronting plate against the resilient biasing of the resilient member to allow the interlocking members to release so that the mask can be withdrawn from the recess.

12. A label applicator for applying a label to an article comprising:

a supporting structure;

an applicator section mounted on the supporting structure and including a housing adapted to be coupled to a supply of gas under pressure and having a label receiving surface, said label receiving surface having an opening therein;

a label dispenser for dispensing a label onto said label receiving surface, said applicator section retaining the label against the label receiving surface in at least partial registry with said opening whereby the label can be blown by the gas under pressure from the label receiving surface and applied to an article; and said applicator section including a gas distributor upstream from said label receiving surface, said gas distributor comprising a grid manifold having a gas inlet port communicating with a plurality of intersecting grooves, each of said grooves having an outer region and a midpoint, said gas distributor further comprising a chamber plate having a plurality of gas inlet ports, each of which communicates with a plurality of intersecting grooves on said chamber plate, each of the chamber plate intersecting grooves having an outer region and a midpoint, said grid manifold and said chamber plate being attached to one another so that each of the gas inlet ports on said chamber plate is in registry with an outer region of one of the grooves on said grid manifold.

13. The label applicator as recited in claim 12, wherein said gas distributor further comprises a second chamber plate having a plurality of gas inlet ports, each of which communicates with a plurality of intersecting grooves on said second chamber plate, each of the second chamber plate intersecting grooves having an outer region and a midpoint, said chamber plate and said second chamber plate being attached to one another so that each of the gas ports on said second chamber plate is in registry with an outer region of one of the grooves on said chamber plate.

14. The label applicator as recited in claim 12, wherein said grid manifold and said chamber plate are affixed to one another in face-to-face abutting relationship so that the chamber plate closes off major portions of the grooves on said grid plate, thereby defining an inlet chamber with four outlet ports at the ends of each of the intersecting grooves on the grid plate, each of the four outlet ports being in registry with a corresponding one of the inlet ports on the chamber plate.

15. The label applicator as recited in claim 14, wherein said chamber plate and said second chamber plate are affixed to one another in face-to-face abutting relationship so that the second chamber plate closes off major portions of the grooves on said chamber plate, thereby defining a plurality of inlet chambers;

said inlet chambers being each comprised of a set of the intersection grooves disposed on the chamber plate, so that the number of defined inlet chambers is equal to the number of sets of intersecting grooves disposed on said chamber plate, wherein each defined inlet chamber has four outlet ports at the ends of each of the intersecting grooves defining said inlet chamber;

wherein each of the four outlet ports on each inlet chamber disposed on said chamber plate is in registry with a corresponding one of the inlet ports on the second chamber plate.

* * * * *